US008876428B2

(12) United States Patent
Pallenberg

(10) Patent No.: US 8,876,428 B2
(45) Date of Patent: Nov. 4, 2014

(54) METHOD OF REPAIRING A COURT SURFACE

(71) Applicant: Carvin Pallenberg, Madison, CT (US)

(72) Inventor: Carvin Pallenberg, Madison, CT (US)

( * ) Notice: Subject to any disclaimer, the term of this patent is extended or adjusted under 35 U.S.C. 154(b) by 0 days.

(21) Appl. No.: 13/861,472

(22) Filed: Apr. 12, 2013

(65) Prior Publication Data

US 2014/0270951 A1 Sep. 18, 2014

Related U.S. Application Data

(60) Provisional application No. 61/791,404, filed on Mar. 15, 2013.

(51) Int. Cl.
*E01C 13/06* (2006.01)

(52) U.S. Cl.
CPC ..... *E01C 13/065* (2013.01)
USPC ..... 404/31; 404/75; 427/136

(58) Field of Classification Search
USPC ..... 404/31, 75, 72; 427/136
See application file for complete search history.

(56) References Cited

U.S. PATENT DOCUMENTS

| | | | | |
|---|---|---|---|---|
| 3,932,051 | A | 1/1976 | Cleary | |
| 3,993,412 | A | 11/1976 | Drane | |
| 4,113,401 | A | 9/1978 | McDonald | |
| 4,897,302 | A | 1/1990 | Bull | |
| 5,185,013 | A | 2/1993 | Martin | |
| 5,411,352 | A * | 5/1995 | Eren | 404/31 |
| 5,464,304 | A | 11/1995 | Dittmar | |
| 6,291,368 | B1 | 9/2001 | Lee | |
| 6,450,729 | B1 | 9/2002 | Clapp | |
| 6,786,674 | B1 * | 9/2004 | Hanks | 404/32 |
| 7,168,887 | B1 | 1/2007 | Rossi | |
| 7,396,185 | B2 * | 7/2008 | Rossi | 404/75 |
| 7,597,503 | B2 | 10/2009 | Hinding et al. | |
| 2003/0215603 | A1 | 11/2003 | Lee | |
| 2004/0120765 | A1 | 6/2004 | Jones, IV et al. | |
| 2006/0123736 | A1 | 6/2006 | Futterman | |
| 2010/0014915 | A1 | 1/2010 | Hinding et al. | |

OTHER PUBLICATIONS

Eternabond website http://web.archive.org/web/20060311111434/www.eternabond.com (http://web.archive.org/web/20060311111853/www.eternabond.com/faq.htm, http://web.archive.org/web/20060311112356/www.eternabond.com/tech/WebSeal.pdf; http://web.archive.org/web/20060311111539/www.eternabond.com/detail.asp?id=ebwbs; http://web.archive.org/web/20060311.

* cited by examiner

*Primary Examiner* — Gary Hartmann
(74) *Attorney, Agent, or Firm* — LeClairRyan, a Professional Corporation

(57) ABSTRACT

This invention relates to a method of repairing a court surface. This method involves applying a liquid adhesive to the court surface; covering the court surface to which the liquid adhesive has been applied with a fabric; applying a first layer of sand to the fabric-covered surface; applying a first binder coating to the first layer of sand; applying one or more additional layers of sand; applying a further binder coating to each of the one or more additional layers of sand; applying a first coat of an acrylic resurfacer to the further binder coating last applied; and applying a second coat of an acrylic resurfacer to the first coat of acrylic resurfacer to repair the court surface.

19 Claims, 2 Drawing Sheets

METHOD OF REPAIRING A COURT SURFACE

This application claims the priority benefit of U.S. Provisional Patent Application Ser. No. 61/791,404, filed Mar. 15, 2013, which is hereby incorporated by reference in its entirety.

FIELD OF THE INVENTION

This invention relates to a method of repairing a court surface.

BACKGROUND OF THE INVENTION

Tennis courts, basketball courts, volleyball courts, running tracks, and other athletic and recreational surfaces are known to deteriorate over time. For example, such surfaces develop cracks, become unlevel with low and high spots due to a change in the subsurface below, and obtain air pockets under the surface that create "dead spots" (e.g., where a ball fails to bounce in its normal way). Such defects are, at a minimum, disruptive to athletic activities, but may also present safety hazards, particularly when the surface is being used for competitive activities.

Outdoor courts that are subject to climates with freeze-thaw cycles caused by large variations in temperature throughout the year are most susceptible to developing defects. The most common problem with outdoor asphalt tennis courts today is cracks. The formation of small hairline cracks can quickly develop into larger cracks when water filters into the crack and freezes during colder temperatures. The pressure created by ice in a crack can cause larger separations which render the paved surface uneven. If cracks are left without repair the entire surface can be damaged, requiring replacement of large portions of or even the entire surface. Thus, development of cracks in paved surfaces presents a continuous maintenance problem.

Current methods of repairing cracks in courts involve filling cracks with a fill material that hardens to form a surface which is level with the surrounding surface. This method is much less expensive than resurfacing an entire section of the pavement. Other methods of repairing cracks in a paved surface employ a slip-sheet method, which involves the application of multiple layers of material over a crack or crevice, with at least some of the layers being allowed to slip against each other (i.e., the layers are not adhesively in contact with one another). The slip-sheet method is intended to alleviate stresses which cause crack formation by allowing movement of the repair patch near the crack. However, filling a crack with a fill material provides only a temporary repair. Moisture can seep into small gaps between the fill material and the crack and pressure caused by freezing and thawing can cause the crack to expand. Moreover, slip sheet methods of crack repair suffer from heaving, and the formation of bubbles and dead spots at the repair site can render the repaired paved surface uneven.

Methods of complete surface replacement are known. According to one method, a special fabric is applied over an entire tennis court surface instead of to only individually visible cracks. The fabric is purposely not bonded to the court surface so as to allow the base to expand and contract at will. The problem with such a method is that air bubbles can form under the fabric to create dead spots that render the court surface uneven and unplayable.

Similar problems are seen with courts constructed from a cushion material overlaid onto a concrete or asphalt surface.

The cushion material is not adhered to the underlying concrete or asphalt surface, and moisture that accumulates between the cushion material and the underlying concrete or asphalt surface heats up during warm weather and creates steam that causes air bubbles under the court surface. These air bubbles cause dead spots on the court surface.

The present invention is directed to overcoming these and other deficiencies in the art.

SUMMARY OF THE INVENTION

The present invention relates to a method of repairing a court surface. This method involves applying a liquid adhesive to the court surface; covering the court surface to which the liquid adhesive has been applied with a fabric; applying a first layer of sand to the fabric-covered surface; applying a first binder coating to the first layer of sand; applying one or more additional layers of sand; applying a further binder coating to each of the one or more additional layers of sand; applying a first coat of an acrylic resurfacer to the further binder coating last applied; and applying a second coat of an acrylic resurfacer to the first coat of acrylic resurfacer to repair the court surface.

The method of the present invention has the advantage of providing a resurfaced court that eliminates cracks, uneven surfaces, and dead spots, and also prevents the formation of these features as a result of its layered system of materials and underlying fabric layer that adheres to, releases from, and re-adheres to the underlying concrete or asphalt surface.

DETAILED DESCRIPTION OF THE INVENTION

Figure 1:
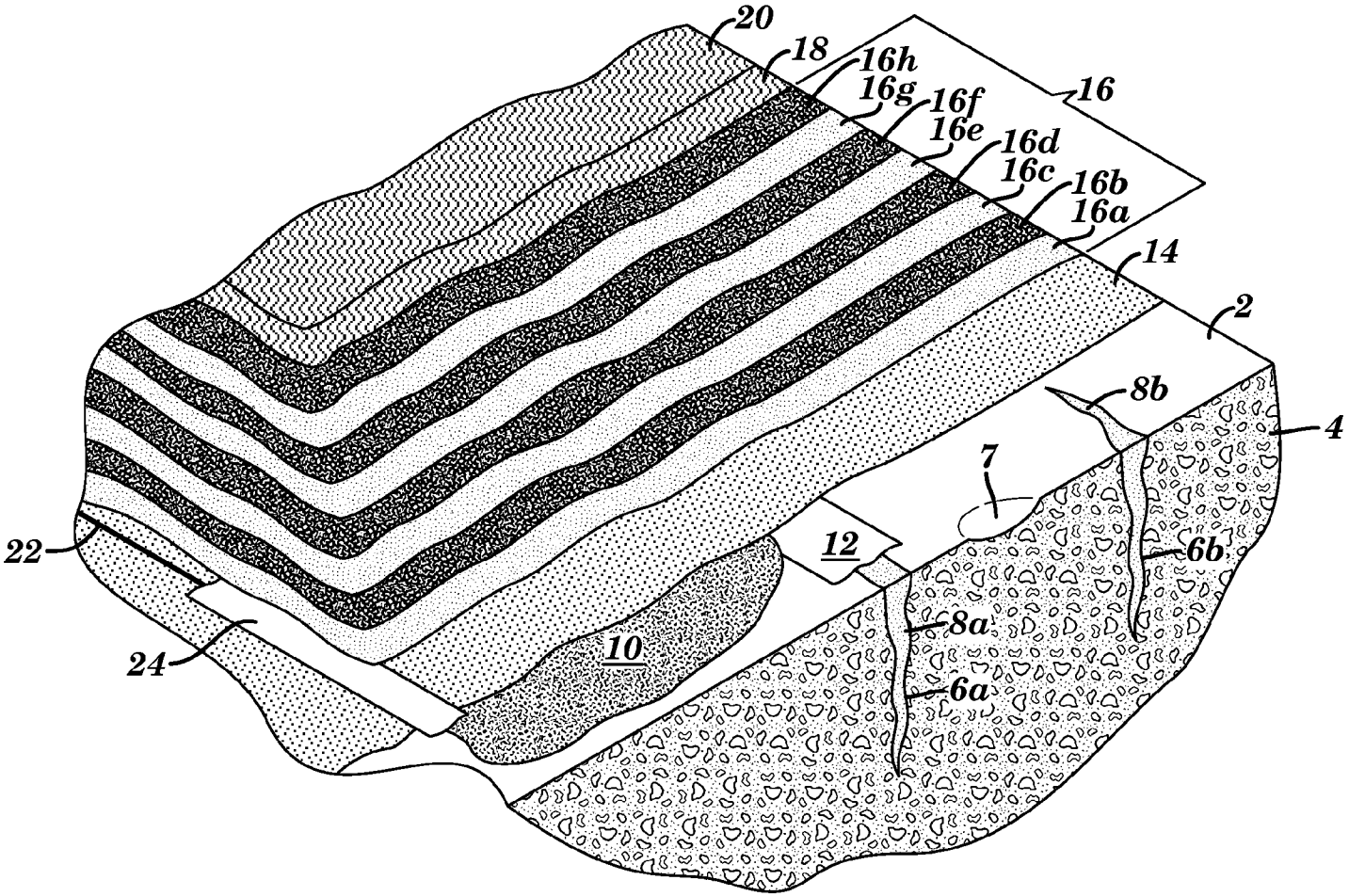
FIG. 1 is a cross-sectional, perspective, peeled-away view of layers applied to a court surface in a method of repairing a court surface according to one embodiment of the present invention.

The present invention relates generally to a method of repairing a court surface, particularly the surface of athletic courts, such as tennis courts, basketball courts, volleyball courts, and running tracks. According to the method of the present invention, court surfaces with cracks, uneven surfaces, and/or dead spots can be repaired to eliminate such defects and to prevent the formation of these defects. The method of the present invention involves, in general, a layered system of weighted material with an underlying fabric layer that adheres to, but is capable of releasing from and re-adhering to an underlying concrete or asphalt surface.

According to one aspect, the present invention relates to a method of repairing a court surface. This method involves applying a liquid adhesive to the court surface; covering the court surface to which the liquid adhesive has been applied with a fabric; applying a first layer of sand to the fabric-covered surface; applying a first binder coating to the first layer of sand; applying one or more additional layers of sand; applying a further binder coating to each of the one or more additional layers of sand; applying a first coat of an acrylic resurfacer to the further binder coating last applied; and applying a second coat of an acrylic resurfacer to the first coat of acrylic resurfacer to repair the court surface.

Court surfaces suitable for repair according to the method of the present invention may be formed of any of a variety of pavement materials including, without limitation, asphalt and concrete materials. Other pavement materials which are subject to cracking may also be repaired by the method of the present invention.

In one embodiment, the method of the present invention involves eliminating cracks in the court surface. The depth of a crack may vary from a shallow surface crack which extends only a short distance into the court surface and/or its underlying concrete or asphalt surface, to a more penetrating crack which extends deeply into and/or through the court surface and any underlying pavement.

The method of the present invention is also suitable for resurfacing a court that is uneven. For example, the method of the present invention can repair a court that has low spots or high spots that have developed over time as a result, e.g., of shifting rock or soil below the surface of the court.

In one embodiment of carrying out the method of the present invention, the court is first prepared for repair. Preparing a court for resurfacing according to the method of the present invention may involve cleaning the court surface and any cracks of any loose debris, such as dust, dirt, gravel, crumbled asphalt or concrete, or any other type of loose debris material. This can be accomplished by blowing compressed air onto the court surface and/or into cracks, by applying a vacuum, or by brushing or sweeping the surface and/or cracks to remove the debris. In one embodiment, the court surface is cleaned with a power-washer.

For a court surface with existing cracks, once the cracks are cleaned for lose debris, the crack may be filled with a fill material, such as a concrete and/or binder material. A suitable fill material for preparing cracks for resurfacing according to the method of the present invention includes, without limitation, a mixture of sand, cement, and latex. In one embodiment, cracks are filled with a 3000 psi concrete material. Cracks are filled with fill material to a level even or substantially even with the surrounding court surface. After the fill material dries, it can be scraped, ground, sanded, or buffed flush with the surrounding court surface to level the filled cracks with the surrounding court surface. The court surface and fill material surface can then be cleaned (e.g., broomed or blown) of dust and/or other debris. In one embodiment, the paved surface and fill material surface are dry and preferably at a temperature of about 60° F. or warmer prior to carrying out other steps in the method of the present invention.

Once existing cracks are filled and leveled with the surrounding court surface, it may be desirable to cover the leveled, filled cracks with a tape, for example, a crack-sealing tape. One suitable example of a crack-sealing tape includes, without limitation, Performance Court Crack Barrier tape. In one embodiment, the crack-sealing tape is watertight and has the ability to remain flexible at temperatures as low as about −70° F. to more than 200° F. Other watertight materials which are flexible and pliable at a wide range of temperatures may also be used. In one embodiment, the crack-sealing tape has a thickness of about 0.1 mm to about 2 mm, about 0.25 mm to about 1.75 mm, about 0.5 mm to about 1.5 mm, about 0.75 mm to about 1.25 mm, or about 1 mm.

In one embodiment, the crack-sealing tape is applied to the court surface above cracks by using, e.g., a linoleum roller to provide a solid bond between the crack-sealing tape and the existing court surface.

After the court is prepared by filling, leveling, and covering existing cracks, the court surface may then be prepared by leveling the court surface where needed. This may include, for example, repairing low spots (see, e.g., low spot 7 in FIG. 1) by filling low spots with a filler material. For example, low spots may be filled with a filler material comprising a mixture of Portland cement, sand, and court patch binder. Filled spots can then be sanded smooth, e.g., with a motorized floor sander. For existing high spots, these can be removed by grinding.

Figure 2:
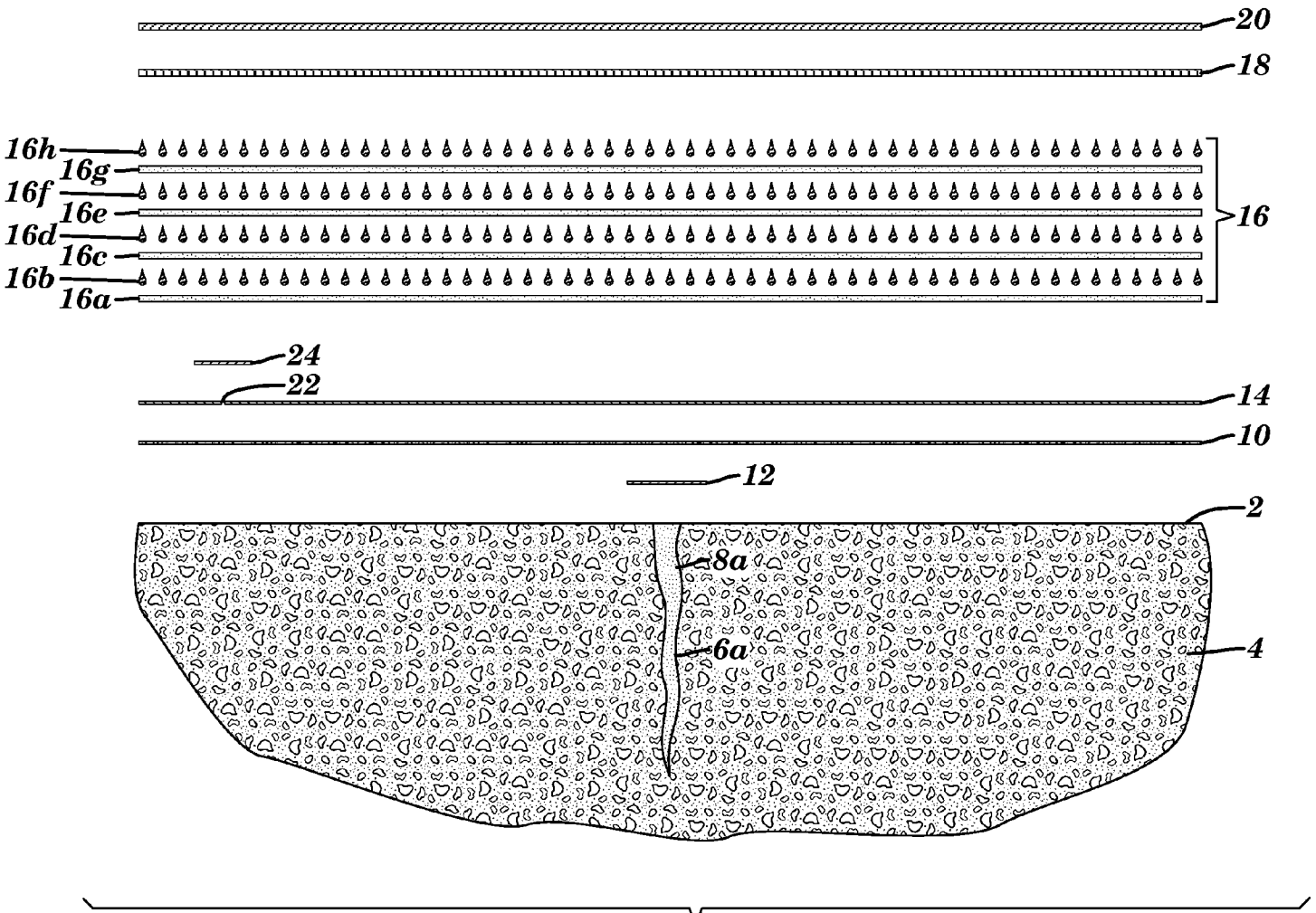
FIG. 2 is a cross-sectional, exploded view of a court surface repaired according to one embodiment of the method of the present invention.

Referring now to FIG. 1 and FIG. 2, illustrated is court surface 2 and underlying concrete or asphalt surface 4 with various layers applied to court surface 2 to repair court surface 2 and underlying concrete or asphalt surface 4 according to the method of the present invention. As illustrated, cracks 6*a* and 6*b* in court surface 2 and underlying concrete or asphalt surface 4 have been filled with binder/filler material 8*a* and 8*b*, respectively.

Crack-sealing tape 12 has been applied to cover binder/filler material 8*a* in crack 6*a*. In one embodiment, crack-sealing tape 12 is applied using a linoleum roller to provide a solid bond between tape 12 and the existing court surface 2.

According to the method of the present invention, liquid adhesive 10 is then applied onto court surface 2, including onto crack-sealing tape 12. While only a portion of court surface 2 is shown to have liquid adhesive 10, in one embodiment, liquid adhesive 10 is applied to the entire court surface 2. A suitable type of liquid adhesive for use in the present invention includes PC50 or other liquid adhesives with similar properties.

In one embodiment, liquid adhesive 10 is applied by flood coating court surface 2 under conditions to saturate court surface 2. Application of liquid adhesive 10 may be carried out using a sprayer, such as that typically used in e.g., application of agricultural chemicals to crop plants. In one embodiment, after liquid adhesive 10 is applied to court surface 2 it is allowed to at least partially dry until it becomes tacky.

Court 2 is then covered with fabric 14. In one embodiment, fabric 14 is a cushion fabric, for example, PC300 cushion fabric, although other types/brands of fabric may be used. Fabric 14 may be applied by using a weighted roller to secure fabric 14 to the tacky composition of liquid adhesive 10. Since fabric 14 will typically need to be applied to court surface 2 in commercially-available sheets of a limited width, fabric 14 may have seam 22 between two sheets of fabric 14. In one embodiment, seam 22 is sealed or joined with seaming tape 24.

In laying fabric 14 onto liquid adhesive 10, it may be desirable to first snap a chalk line on liquid adhesive 10 parallel from the court edge at a distance equal to or about equal to the width of the sheet of fabric 14 to ensure that fabric 14 is laid down straight.

Since liquid adhesive 10 is tacky, fabric 14 adheres to court surface 2 (and any crack-sealing tape 12). However, fabric 14 may also become detached from court surface 2 (and any crack-sealing tape 12) under highly stressful conditions, but then re-adheres to court surface 2 (and any crack-sealing tape 12). Thus, contrary to court re-surfacing that involves a detached, floating fabric layer, the present invention has an underlying fabric layer that adheres to the underlying existing court surface.

Fabric 14 is then covered with a series of sand layers and binder coating layers, illustrated as sand/binder layer 16 in FIG. 1. Specifically, first layer of sand 16*a* is followed by first binder coating 16*b*, second layer of sand 16*c* is followed by second binder coating 16*d*, third layer of sand 16*e* is followed by third binder coating 16*f*, and fourth layer of sand 16*g* is followed by fourth binder coating 16*h*. In one embodiment, the sand in each of first layer of sand 16*a*, second layer of sand 16*c*, third layer of sand 16*e*, and fourth layer of sand 16*g* substantially comprises 00N sand, although other grades of sand may also be used.

In one embodiment, sand in each of first layer of sand 16*a*, second layer of sand 16*c*, third layer of sand 16*e*, and fourth layer of sand 16*g* is applied at a rate of about 2-3 lbs/square yard or, more particularly, at a rate of about 2.5 lbs/square yard.

A suitable binder coating for each of first binder coating 16*b*, second binder coating 16*d*, third binder coating 16*f*, and fourth binder coating 16*h* is PC140 or any other binder coating material with similar properties. Sand/binder layer 16 provides needed weight to keep fabric 14 adhered to liquid adhesive 10, except during excessive amounts of stress, and to prevent the formation of air bubbles below the court surface which can result in the formation of dead spots.

The sand in sand/binder layer 16 is, according to one embodiment, applied using a broadcast spreader to evenly distribute the sand across court surface 2. In one embodiment, the sand is applied, e.g., in a North-South direction to form a layer and then in an East-West direction to form another layer. Thus, according to one embodiment, first layer of sand 16*a* and third layer of sand 16*e* are applied in one direction (e.g., a North-South direction) while second layer of sand 16*c* and fourth layer of sand 16*g* are applied in a direction perpendicular to (e.g., an East-West direction) first layer of sand 16*a* and third layer of sand 16*e*.

In applying sand/binder layer 16, it may be desirable to drag-broom the sand in one or more of the layers (e.g., after applying third layer of sand 16*e* and/or fourth layer of sand 16*g*) before applying the subsequent binder layer to evenly distribute the sand and/or to fill any low spots that may exist in court surface 2. Alternatively, sand in sand/binder layer 16 may be distributed using a Fresno trowel to evenly spread sand across the court surface. These strategies will help to evenly distribute the sand, e.g., to fill-in bare spots or distribute fat spots, adding or disbursing sand where necessary to provide an even coating of sand.

Application of binder layers 16*b*, 16*d*, 16*f*, and 16*h* in sand/binder layer 16 may be carried out using a sprayer, such as that typically used in, e.g., application of agricultural chemicals to crop plants.

In carrying out the method of the present invention, after sand/binder layer 16 is laid down, first acrylic resurfacer 18 is then applied, which is then covered by second acrylic resurfacer 20. In one embodiment, first acrylic resurfacer 18 is sanded before applying second acrylic resurfacer 20.

To complete the court resurfacing, one or more color coatings may be applied to second acrylic resurfacer 20 as desired, followed by lines to properly mark a court.

Although the invention has been described in detail for the purpose of illustration, it is understood that such detail is solely for that purpose, and variations can be made therein by those skilled in the art without departing from the spirit and scope of the invention which is defined by the following claims.

What is claimed:

1. A method of repairing a court surface, said method comprising:

applying a liquid adhesive to the court surface;

covering the court surface to which the liquid adhesive has been applied with a fabric;

applying a first layer of sand to the fabric-covered surface;

applying a first binder coating to the first layer of sand;

applying one or more additional layers of sand;

applying a further binder coating to each of the one or more additional layers of sand;

applying a first coat of an acrylic resurfacer to the further binder coating last applied; and applying a second coat of an acrylic resurfacer to the first coat of acrylic resurfacer to repair the court surface.

2. The method according to claim 1 further comprising:

preparing the court surface for repair.

3. The method according to claim 2, wherein said preparing comprises:

filling existing cracks in the court surface with a concrete and/or binder material;

leveling the filled cracks with the court surface;

covering the leveled, filled cracks with a crack-sealing tape; and leveling the court surface.

4. The method according to claim 3, wherein the crack-sealing tape has a thickness of about 1 mm.

5. The method according to claim 1, wherein said applying one or more additional layers of sand comprises applying a second layer of sand, a third layer of sand, and a fourth layer of sand.

6. The method according to claim 5, wherein said applying a further binder coating to each of the one or more additional layers of sand comprises applying a second binder coating to the second layer of sand, applying a third binder coating to the third layer of sand, and applying a fourth binder coating to the fourth layer of sand.

7. The method according to claim 1 further comprising:

applying a seaming tape to any seams in the fabric.

8. The method according to claim 1 further comprising:

applying one or more color coatings to the second coat of an acrylic resurfacer.

9. The method according to claim 1, wherein said applying a liquid adhesive is carried out under conditions to saturate the court surface.

10. The method according to claim 9 further comprising:

drying the liquid adhesive until it becomes tacky.

11. The method according to claim 1, wherein the liquid adhesive permits release and re-adherence of the fabric to the court surface.

12. The method according to claim 1, wherein the fabric is a cushion fabric.

13. The method according to claim 1, wherein said covering the surface with a fabric comprises rolling the fabric with a weighted roller.

14. The method according to claim 1 further comprising:

applying fiberglass to any seams in the fabric.

15. The method according to claim 1, wherein the first layer of sand and the one or more additional layers of sand are applied using a broadcast spreader.

16. The method according to claim 1 further comprising:

drag-brooming the sand after applying each of the first layer of sand and the one or more additional layers of sand to evenly distribute the sand.

17. The method according to claim 1, wherein said applying a liquid adhesive is carried out using a sprayer.

18. The method according to claim 1, wherein said applying a first binder coating and applying a further binder coating is carried out using a sprayer.

19. The method according to claim 1 further comprising:

sanding the first coat of acrylic resurfacer.

* * * * *